US007614463B1

(12) United States Patent
Hunziker

(10) Patent No.: US 7,614,463 B1
(45) Date of Patent: Nov. 10, 2009

(54) FLUTE-WIPING AUGER CLEANER

(76) Inventor: David G. Hunziker, P.O. Box 211, Fort Scott, KS (US) 66701

( * ) Notice: Subject to any disclaimer, the term of this patent is extended or adjusted under 35 U.S.C. 154(b) by 0 days.

(21) Appl. No.: 11/977,168

(22) Filed: Oct. 23, 2007

Related U.S. Application Data

(60) Provisional application No. 60/853,970, filed on Oct. 23, 2006.

(51) Int. Cl.
*E21B 12/06* (2006.01)

(52) U.S. Cl. ..... 175/84; 175/313; 175/316; 15/256.53

(58) Field of Classification Search ..... 175/84, 175/313, 316; 15/256.5, 256.51, 256.53
See application file for complete search history.

(56) References Cited

U.S. PATENT DOCUMENTS

| | | | | |
|---|---|---|---|---|
| 613,369 | A | 11/1898 | Hirlinger | 294/86.29 |
| 720,078 | A | 2/1903 | Smith et al. | 294/86.28 |
| 760,219 | A | 5/1904 | Lisle | 294/86.14 |
| 879,812 | A | 2/1908 | Button et al. | 294/86.13 |
| 1,223,034 | A | 4/1917 | Colgan et al. | 294/86.13 |
| 1,290,127 | A | 1/1919 | Drake | 294/86.13 |
| 1,352,172 | A | 9/1920 | Brandon | 294/86.26 |
| 1,455,499 | A | 5/1923 | Lang | 294/86.2 |
| 1,526,174 | A | 2/1925 | Obermuller | 294/86.29 |
| 1,542,099 | A | 6/1925 | Rogers | 294/86.29 |
| 1,587,021 | A | 6/1926 | Montgomery | 294/86.29 |
| 4,944,543 | A | 7/1990 | Walsh | 294/86.29 |
| 5,655,610 | A * | 8/1997 | Skinner | 175/84 |

OTHER PUBLICATIONS

National Driller vol. 26, No. 12 Dec. 2005.

* cited by examiner

*Primary Examiner*—Jennifer H Gay
*Assistant Examiner*—Elizabeth C Gottlieb
(74) *Attorney, Agent, or Firm*—Jonathan A. Bay

(57) ABSTRACT

A flute-wiping auger cleaner has a laterally-shearing shackle, an axial track spaced parallel to the auger; and a traveling carriage on the track for supporting the shackle. The shackle includes a series of angularly-staged wiper blades to project into the flute of the auger and centrally stabilize the blades on the turning axis of the auger. The shackle is biased not only to pressure the wipers inwards towards the auger's cylindrical sidewall but also allow the shackle to open slightly against the force of the bias in event a blade cannot dislodge a difficult clump of fouling material in the flute. In that event, the blade is pushed out and then pressured back in as it rides over the difficult-to-dislodge clump. Spinning the auger causes the blades to travel the length of the helical flute while the shackle travels axially on the track.

17 Claims, 7 Drawing Sheets

FLUTE-WIPING AUGER CLEANER

CROSS-REFERENCE TO PROVISIONAL APPLICATION(S)

This application claims the benefit of U.S. Provisional Application No. 60/853,970, filed Oct. 23, 2006, which is incorporated herein by this reference thereto.

BACKGROUND AND SUMMARY OF THE INVENTION

The invention relates to boring the earth and, more particularly, to an above-ground cleaner for the earth bore that will strip, wipe, scrape, or break off adhering accumulations of mud or cuttings.

The inspiration for the invention includes without limitation the activity of hollow stem auger retraction from being downhole, as in a well bore. The conventional occasion nowadays for wanting to do so is during construction of an environmental monitoring well.

Briefly, groundwater monitoring/remediation wells are bored into the earth. A bore hole is formed by down-feeding a string of hollow stem auger sections. FIG. 1, for example, shows the topmost section of such an auger string (the rest of the string being downhole and out of view). Once the string has bored through to the desired depth, the process then begins of retracting the string.

The purpose behind the auger sections (and consequent string) being hollow is for the down-feeding and construction of a well-casing in the lumen (hollow core) of the auger string. A casing is typically an assembly of PVC pipe sections twisted together by the counterpart internal and external threaded ends thereof. The casing is intentionally undersized relative to the lumen of the hollow stem auger string in which it is inserted. That way, the hollow stem auger string can be withdrawn from the bore, leaving the PVC pipe casing in place. Also, such an undersized casing presents an annular gap between the bored earth and PVC pipe, and this annular gap is eventually backfilled.

To turn to another matter of the prior art, there is another piece of the background to note, which involves the field equipment used by the workers in this industry:—namely, their drilling rigs. Such drilling rigs have two kinds of devices for retracting the hollow stem auger string:—(1) hydraulically-winched cables or lines, in contrast to, (2) hydraulic cylinders.

It might be noted that hydraulically-winched cables and lines, when used to pull free a stuck object, typically include the danger of recoil. Conversely, hydraulic cylinders in the same situation are essentially recoilless. Another thing about hydraulic-cylinder systems is that, they are powerful, and typically outmuscle the power of the hydraulic winches by several times.

A typical drilling rig utilized in the industry might comprise, for example and without limitation, a CME 750 All-terrain vehicle (a rubber tire vehicle) drilling rig of the Central Mine Equipment Company in St. Louis, Mo. This is the carrier/drilling rig combination which is approximately illustrated in several patents of the CME Company, and for more particular disclosure of such carrier/drilling rig features, reference may be had to any of U.S. Pat. Nos. 3,527,309; 3,561,545 and/or 4,638,871—all of which are by C. L. Rassieur. The foregoing patent disclosures are incorporated fully herein by this reference thereto.

Such a carrier/drilling rig has a two-piece tower comprising, in its lower portion, an undergirding upright, and affixed upon that, a removable mast. The crown of the mast might be outfitted with as many as five sheaves. In a five sheave configuration, typically one sheave serves a wireline cable and winch, another serves softlines perhaps pulled by a cathead, and the remaining three would typically serve three cable-and-winch systems for winching up (for example) sections of drill rod.

The wireline cable and softline-cathead system are not pertinent to the present invention. Typically the wireline cable system reels up a wire relatively fast but with a weak hoist. A weak hoist, for instance, is only able to exert 900 pounds or ~400 kg of force or so, which is fine for rock-coring but is otherwise weak. The cathead is like a capstan on a ship, except oriented on a horizontal turning axis, and can winch in by means of one or two loops not only softlines but also cables or chains as well. It too is typically a weak system.

Stronger still are the (three or so) cable-and-winch systems. It is typical to equip the drilling rig with winches rated between about 1,800 or to 3,200 pounds (~700 to ~1,400 kg). It is also known to include at least one cable-and-winch system as a main one for fishing stuck objects and the like, and provide it with a retraction-force rating as high 10,000 pounds (~4,500 kg). Again, these three cable-and-winch systems are designed for, among other end uses, lifting up sections of drill rod. The height of the tower to the crown of the mast is typically something greater than twenty feet (~6 m) since that is a standard length of sections of drill rod. The above-ground height of the sheaves for the CME 750 ATV is about twenty-seven and a-half feet (~8⅓ m), which means that workers can hoist the twenty-foot (~6 m) rods with clearance to spare. When the CME 750 ATV is equipped with three such hoists (ie., cable-and-winch systems), workers can pull sixty feet of rods without having to lay any down on the ground or on the deck.

The upright (again, the lower part of the tower, which undergirds the upper part, the detachable mast) comprises legs and a standing rotary drive shaft (such as a kelly bar, or sometimes a square bar). The standing rotary drive bar typically has a lower end anchored in a main rotary drive and an upper end held in a bearing. The legs carry between (or among) themselves a traveling rotary table. Drive input to the rotary drive table is received from the standing rotary drive shaft as the traveling rotary table transits up and down the standing rotary drive shaft. The drill drive is typically a pair of serially-suspended links interconnected by a U-joint.

The hydraulic vertical drive system for cycling the traveling rotary drive table between feed ("pulldown") and retraction strokes typically comprises hydraulic cylinders. Theses hydraulic cylinders serve double-duty as the legs for the tower's upright. The main rotary drive and the hydraulic vertical drive system are typically the strongest systems on the carrier/drilling rig. That is, the main rotary drive might deliver 10,000 ft-lbs (~13,5000 Nm) of rotary torque. The hydraulic vertical drive system can typically deliver a feed ("pulldown") force in excess of the weight of the vehicle, or something on the order of 20,000 pounds (~9,000 kg).

The outstanding feature of the hydraulic vertical drive system is the retraction force it can develop:—which is 30,000 pounds (~13,600 kg) for the CME 750 ATV, and then 40,000 pounds (~18,000 kg) being no problem for other models.

As an aside, another aspect of the hydraulic vertical drive system is that, its drive stroke is only about five and a-half feet (~1⅔ m). Unlike drill rod sections (which measure a standard twenty feet or six meters in length), hollow stem auger section conventionally measure a standard five feet (~1½ m) in length. Therefore, the hydraulic vertical drive system's drive stroke of about five and a-half feet (~1⅔ m) is more than sufficient to provide clearance for withdrawal of hollow stem auger sections.

More importantly, the hydraulic vertical drive system has no cables which can stretch (nor chains which need lubrication). Better yet, the hydraulic vertical drive system is substantially recoilless. When feeding down or retracting up against a stuck hollow stem auger string, as soon as the sticking force is overcome, the hydraulic vertical drive system does not recoil. In contrast, if a winch and cables were being used, cables stretch and the stuck hollow stem auger string (if being retracted up) can let fly after being unstuck (or after being torn apart). The cables might whips (chains would do the same) and so on. Moreover, cables can snap (so can chains). Accordingly, the hydraulic vertical drive system is better at giving precise control over the force applied to downhole tools or objects.

Arguably most significant of all is that, its brute power aside and in spite of being the most powerful system on the carrier/drill rig, the hydraulic vertical drive system is probably the safest.

Now let's return the discussion back to retracting the auger string. Hollow stem auger sections interconnect with each other by their top and bottom collars. The topmost hollow stem auger section is down fed into the bore hole by a drive cap attached to the drill drive (or extension thereof) of the drill rig. FIGS. 1 through 3 show a drive cap and the top collar of the a hollow stem auger section.

When boring a well, workers usually have a mess to deal with, and understandably so, since it is a messy process in a messy environment. The auger sections typically withdraw with adhering accumulations of mud or cuttings caked inside their flutes.

These accumulations of mud or cuttings, if left to dry, harden as hard as sun-baked bricks, which is no surprise since basically it is the same starting material as used in sun-baked bricks. It would be desirable to clean the auger sections of such accumulations of mud or cuttings as soon as practicable after withdrawal from the bore hole, while fresh. That is, fresh accumulations of mud or cuttings are easier to clean off than if left to dry. Dried and hardened material is considerably more difficult to get to release. Also, another reason for wiping the auger sections as soon as practicable is that, such accumulations of mud or cuttings are tremendously heavy. Hence the hoisting and handling of the hollow stem auger sections would be considerably eased if unloaded of such material.

What is needed is a solution for this problem.

A number of additional features and objects will be apparent in connection with the following discussion of the preferred embodiments and examples with reference to the drawings.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the skills of a person having ordinary skill in the art to which the invention pertains. In the drawings.

DETAILED DESCRIPTION OF THE PREFERRED EMBODIMENTS

Figure 1:
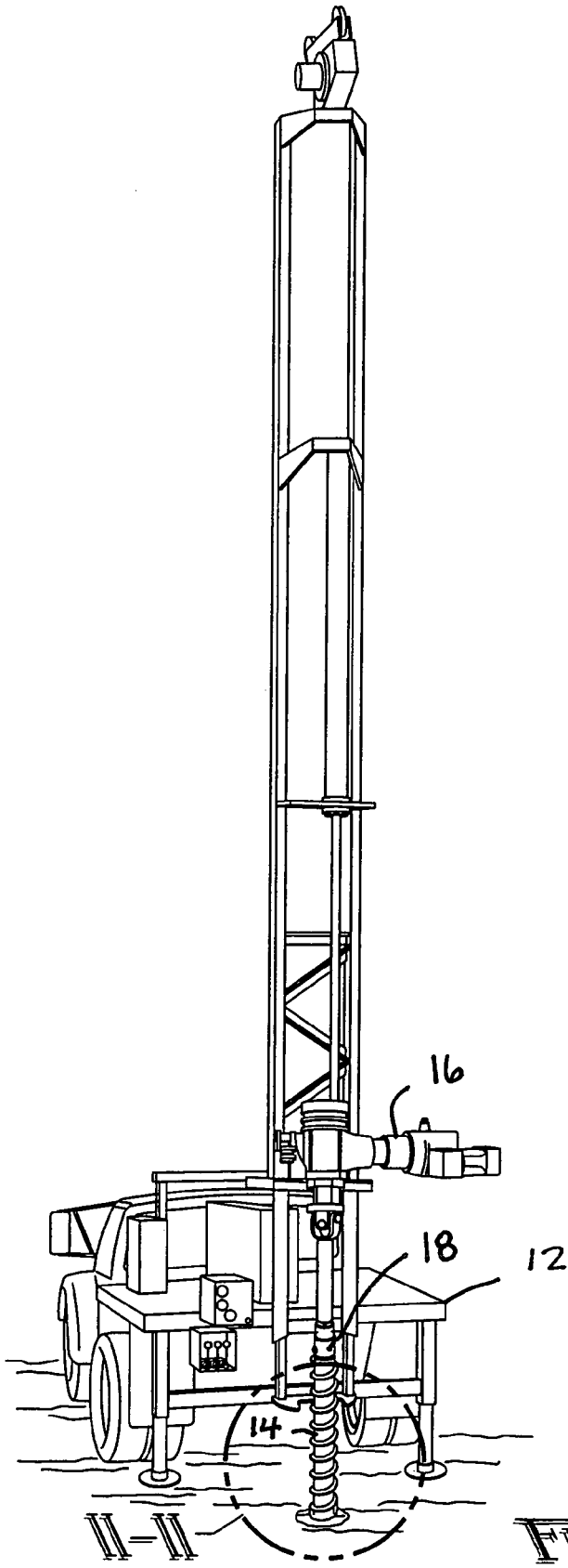
FIG. 1 is a perspective view of a drill rig for boring a well hole with a string of hollow stem auger sections, wherein a topmost auger section is shown above-ground and in the process of the withdrawal of the auger string as a whole (albeit, one section at a time)
Figure 2:
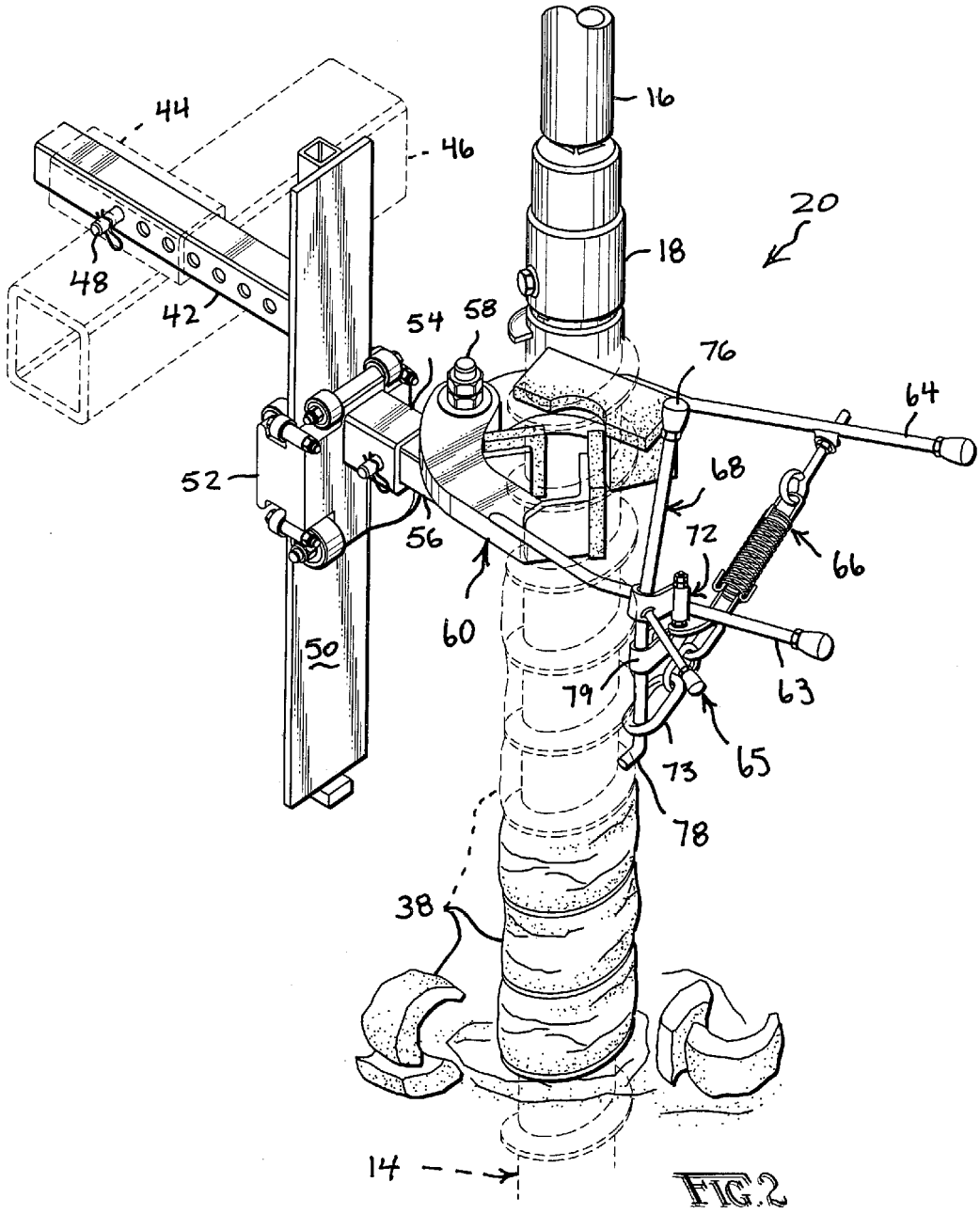
FIG. 2 is an enlarged-scale perspective view of detail II-II in FIG. 1, and focusing in on tail structure of the drill rig over the open well hole which has an auger section sticking part way above-ground therefrom, and including illustration of a flute-wiping auger cleaner in accordance with the invention.
Figure 3:
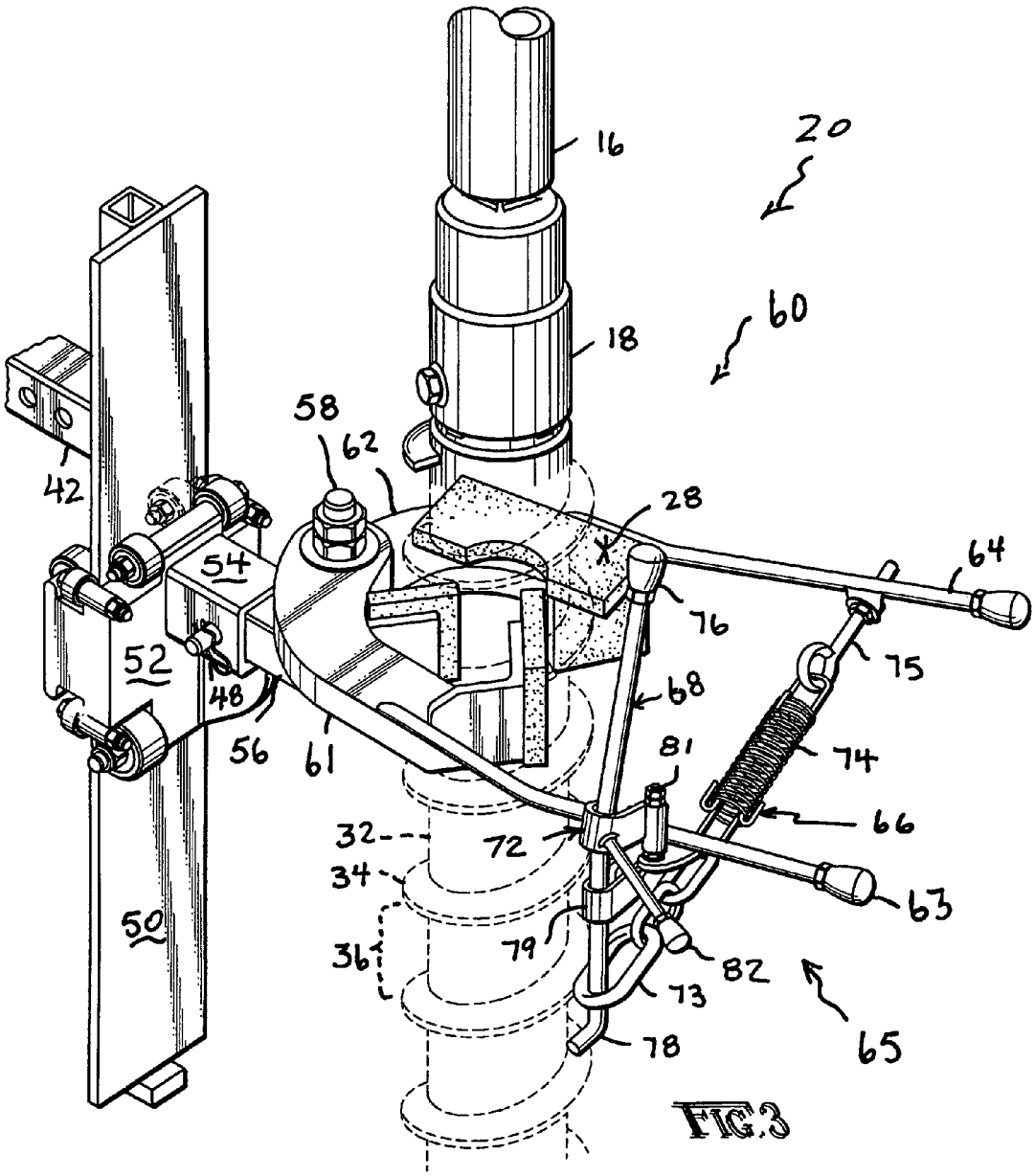
FIG. 3 is an enlarged-scale perspective view of the flute-wiping auger cleaner in FIG. 2.

FIG. 1 shows a drill rig 12 and above-ground portions of a hollow stem auger section 14. FIGS. 2 and 3 show better that the drill rig 12 comprises a drill drive 16 which has a drive cap 18 coupled to the above-ground top collar of the hollow stem auger section 14. FIGS. 2 and 3 also introduce a flute-wiping auger cleaner 20 in accordance with the invention. In general, the inventive flute-wiping auger cleaner 20 is constructed of steel stock materials fastened together by a variety of means including without limitation welds, bolts, clevis as well as corresponding hairpin cotter pins and the like. In some particular instances, the construction materials might include without limitation either non-metallic knobs or, more particularly still, hard synthetic rubber for the wiper blades 24-26 and runner 28 as described much further below.

As a matter of background, and referring to FIG. 2, the hollow stem auger section 14 is basically a pipe (eg., the hollow "stem" 32) that has a helical screw 34 wound around it (and affixed to it). The interspace between coils of the helical screw 34 define a helical channel or "flute" 36 which extends up and down the length of the hollow stem auger section 14.

As FIG. 2 shows, the helical flute 36 is susceptible to fouling by adhering accumulations of mud or cuttings 38, especially when being withdrawn. The flute 36 eventually needs to be cleared of such fouling:—for all kinds of reasons. For one, the fouling is heavy, and it is needless weight to hoist around the job-site, or to rack up on the drill rig 12's storage racks (not shown) and haul around the countryside. For another, if the fouling is damp when fresh then the fouling is also susceptible to drying out over time:—and hence harden to the hardness of ceramic, which will render the auger section 14 inoperable (eg., the auger section 14 is transformed into a thick-walled pipe, with no helical screw 34 projecting beyond the dried-on mud, and so there is nothing to bite into the ground). It is an aspect of the invention to provide a flute-wiping auger cleaner 20 for such situations.

With more general reference to FIG. 2 or 3, the flute-wiping auger cleaner 20 comprises a draw bar 42 for inserting into a general-purpose square receiver 44 on tail structure 46 (eg., bumper or the like) of the drill rig 12. The receiver 44 needless to say is (more or less) permanently mounted to tail structure 46 of the drill rig 12, wherein there is a given presumption that most drill rigs of this kind have such general-purpose square receivers 44 as standard equipment. If not, such general-purpose square receivers 44 can be readily added to such drill rigs as an after-market accessory. The draw bar 42 is releasably locked to the square receiver 44 (and thereby the drill rig 12) by a clevis and hairpin-cotter pin combination 48 as shown.

FIGS. 2 and 3 show that the draw bar 42 terminates in a T-intersection with an upright structure comprising a vertical track 50. Mounted on the vertical track 50 is vertically-traveling carriage 52. The carriage 52 has opposed face rollers for engaging the opposite broad surfaces of the vertical track 50 as well near the margins with the lateral edges thereof, as well as opposed edge rollers for engaging those very same lateral edges of the vertical track 50. Whereas the vertically traveling carriage 52 is free to cycle in up and down strokes on the vertical track 50 in accordance with the dominant applied force causing it to do so, the vertical carriage 52 is tightly constrained to maintain its attitude relative the vertical track 50 despite its freedom to travel up and down.

FIG. 3 shows better that the carriage 52 presents a special-purpose square receiver 54 opposite the vertical track 50. Inserted in this special-purpose square receiver 54 is a cantilevered bar 56 which carries the rest of the structure constituting the flute-wiping auger cleaner 20 in accordance with the invention. The cantilevered bar 56 is releasably locked to the special-purpose square receiver 54 (and thereby the vertically traveling carriage 52) by another clevis and hairpin-cotter pin combination 48 as shown.

Figure 4:
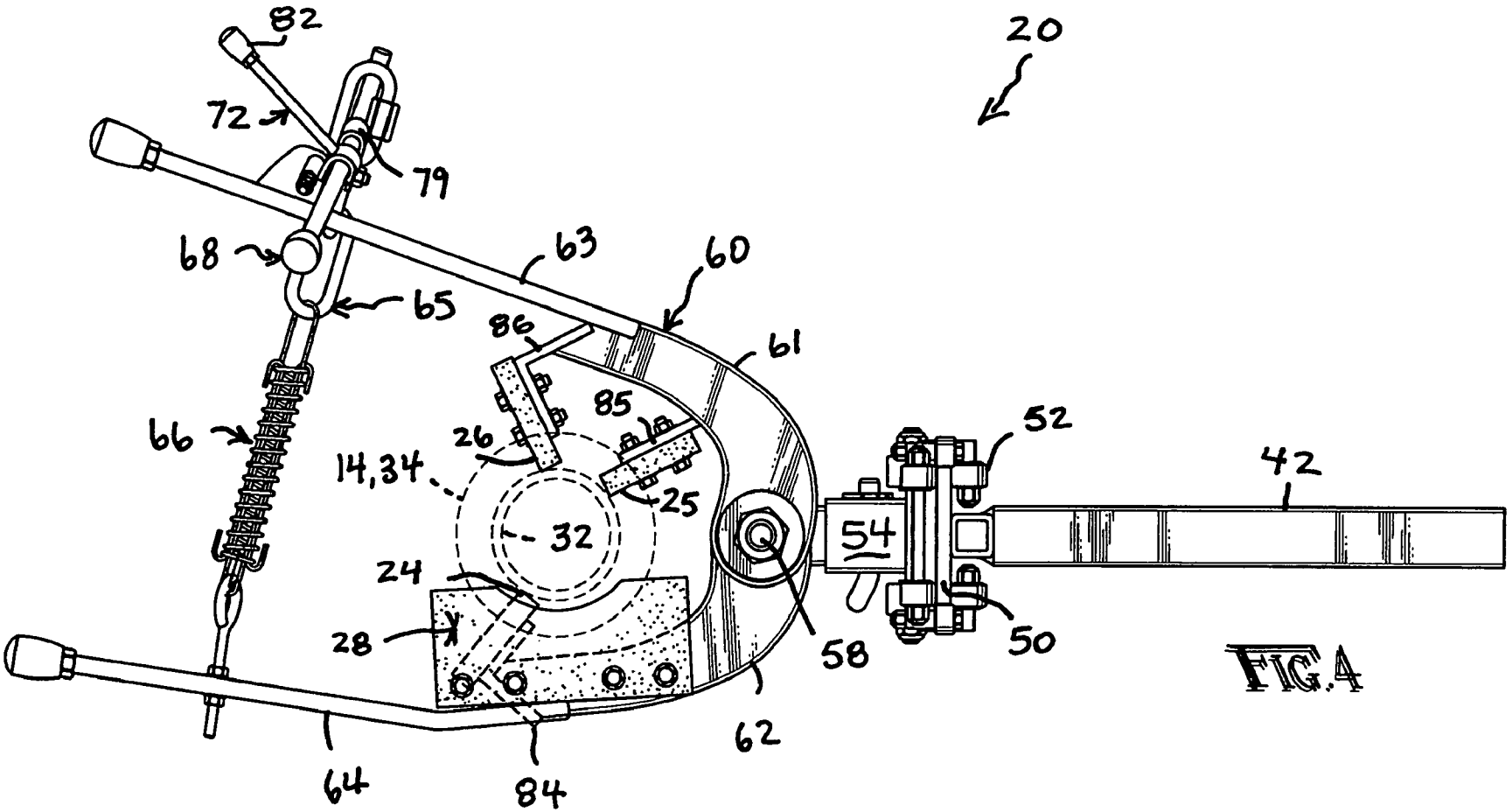
FIG. 4 is a top plan thereof.

FIGS. 3 through 6 show better that the cantilevered bar 56 provides a vertical pivot post 58 (in actuality, bolt) for hitching on a laterally-shearing shackle assembly 60 as shown. As FIGS. 3 and 4 show, the laterally-shearing shackle assembly 60 can be somewhat reckoned as resembling a nutcracker. The shackle assembly 60 comprises a pair of laterally-shearing jaws 61-62 which transition into extended handles 63-64 that extend away therefrom.

In FIG. 3, the nearside jaw is the relatively upper jaw 61 and the farside jaw is the correspondingly lower jaw 62. That is, the nearside jaw 61 travels laterally in a relatively overhead plane relative the plane which the farside jaw 62 travels in, for purposes to be more particularly described below.

Figure 5:
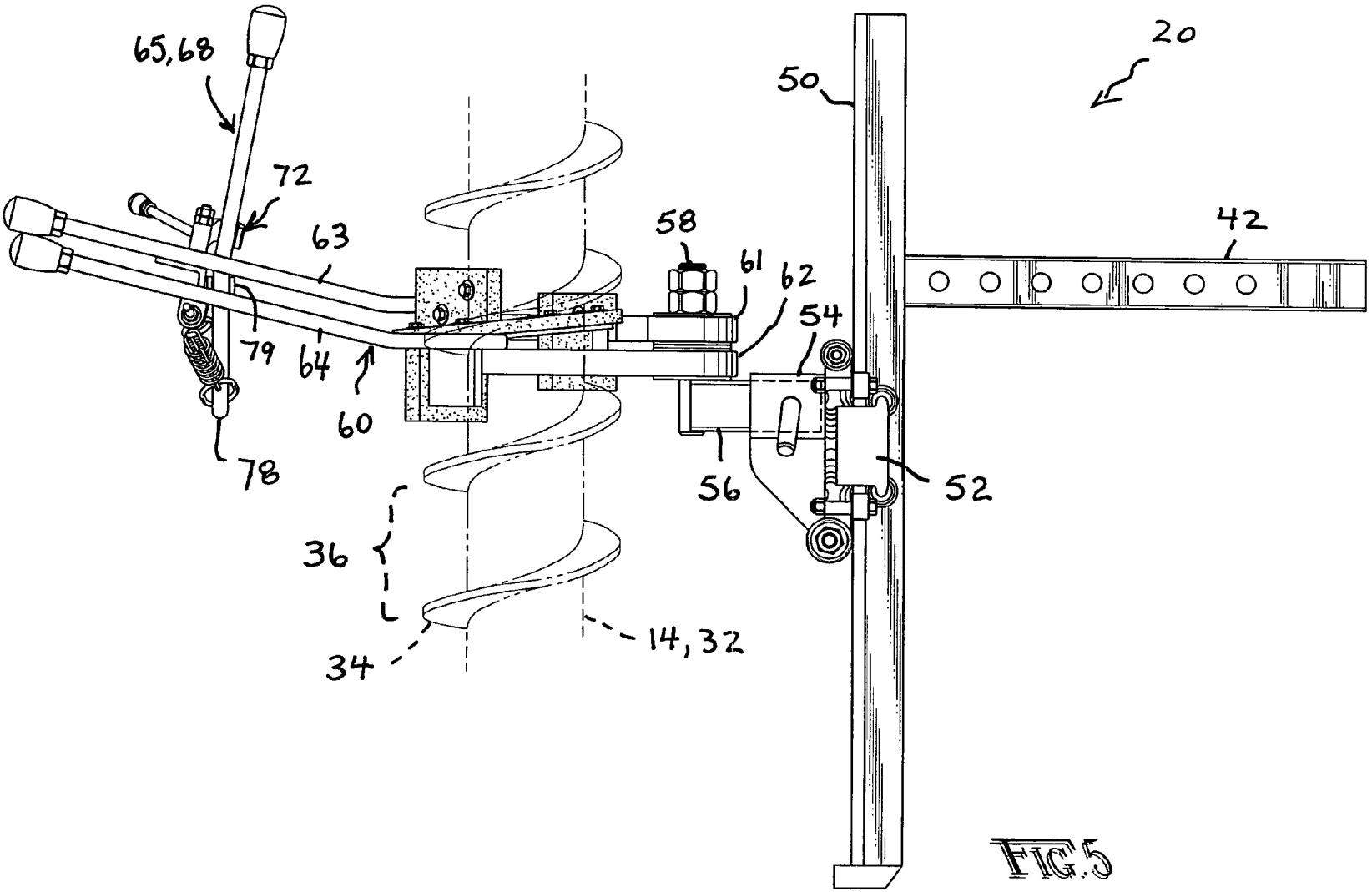
FIG. 5 is a side elevational view thereof.

FIGS. 3 through 5 show that it is an aspect of the invention to clamp the jaws 61-62 on the hollow stem auger section 14 in a relatively latched position as shown, and by a releasable latching system 65. The releasable latching system 65 comprises an extensible tension link 66, a lever 68, and a latch 72. The extensible tension link 66 extends from an origin end attached to the lower handle 64 to a terminal end comprising an eye loop 73.

More particularly, an example embodiment of the extensible tension link 66 comprises a safety-type draw-bar tension spring 74 having one end attached to an eye bolt 75 attached to the lower handle 64 and an opposite end that provides immediately or intermediately for the eye loop 73 (the drawings show one or more oval links that culminate in the ultimate eye loop 73).

The lever 68 comprises rod stock extending between a crank end 76 and a hook end 78. The lever 68 furthermore has middle portion which is secured to a strap 79 that is secured to a mount on the upper handle 63. The crank end 76 serves as the input end. The hook end 78 provides the output motion resulting from the input motion. The strap 79 serves as the fulcrum across which the input motion is converted into the output motion.

The latch 72 comprises a J-shaped piece of flat bar stock, having a hoop end pivotally connected to a bolt 81 or stud fastened to the mount on the upper handle 63. The bight of the J-shaped latch 72 is free to be manipulated about by a grip 82 extending off the J-shaped latch 72 where its bight transitions into the stem thereof.

Figure 6:
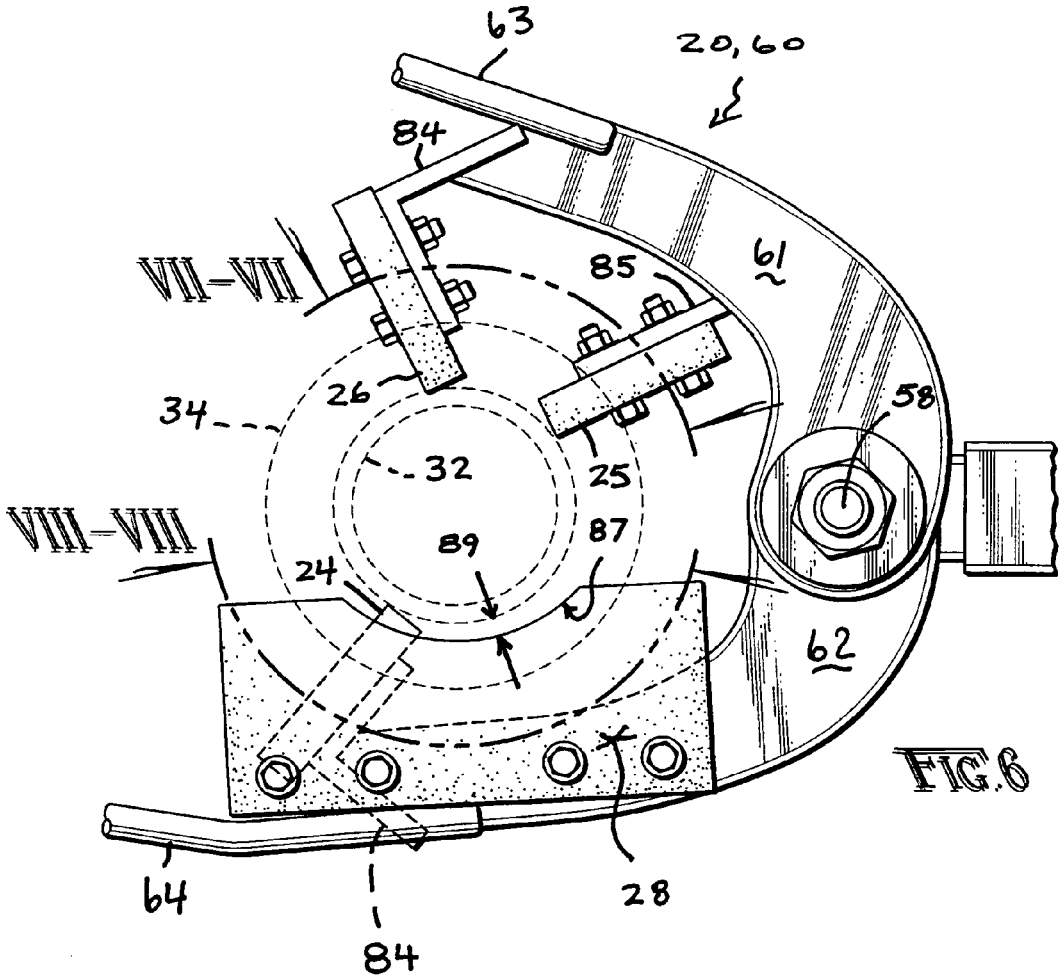
FIG. 6 is an enlarged-scale top plan view comparable to FIG. 4 except zooming in on the jaws thereof.

FIGS. 4 and 6 through 8 show better the preferred configuration of the wiper blades 24-26. As mentioned above, preferably the wiper blades 24-26 are constructed of hard synthetic rubber. That way, the wiper blades 24-26 are fairly stiff but will yield to particularly tough obstacles by resilient flexion. FIGS. 4 and 6 show that the preferred configuration of wiper blades 24-26 comprises a set of three (3) blades that are anchored by clamping brackets 84-86 to the jaws 61-62 in an angularly distributed distribution as shown. The blades 24-26 are disposed to project a wiping edge into one coil of the helical channel that constitutes the flute 36 of the hollow stem auger section 14 as shown.

With continued reference to FIGS. 4 and 6, the set of three (3) blades 24-26 comprises a leading blade 24, a trailing blade 26, and an intermediate blade 25. These descriptive designations for the wiper blades 24-26 presumes (without limitation) that the blades 24-26 are operational to clean the flute 36 from the top end, onward down to the bottom end (ie., from the end closest to the coupling with the drill rig 12's drive cap 18, onward toward the bit end). The leading blade 24 is arranged on an oblique angle of attack relative to the oncoming onslaught of adhering accumulations of mud or cuttings 38. The intermediate blade 25 is arranged on a more or less radial axis (ie., normal axis) and therefore perpendicular to the left-over onslaught of adhering accumulations of mud or cuttings 38. The trailing blade 26 is arranged on an acute angle of attack to the residual adhering accumulations of mud or cuttings 38.

Each of the three (3) blades 24-26 is secured or clamped to one or the other of the jaws 61-62 by its own respective bracket 84-86. The leading blade 24 is secured or clamped by an L-shaped bracket 84 to the lower jaw 62 at about the eight o'clock position (eg., relative an imaginary clock dial superimposed over FIG. 4 or 6). The trailing blade 26 is secured or clamped by an L-shaped bracket 86 to not the lower jaw 62 but the upper jaw 61, and at about the eleven o'clock position. The intermediate blade 25 is secured or clamped not by an L-shaped fabrication but by a straight bracket 85 (eg., flat bar stock). The intermediate blade 25's bracket 85 could be optionally secured or clamped to either the upper or lower jaw 62. The preferred embodiment has the intermediate blade 25's bracket 85 secured or clamped to the upper jaw 61, and at about the two o'clock position.

Each bracket 84-86 is arranged to compliment the angle of attack of the respective blade 24-26. That is, the leading blade 24 that is arranged on the oblique angle of attack is held by its L-shaped bracket 84 such that the blade 24 and bracket 84 are arranged to be pushed out by particularly heavy, thick and/or gummy accumulations of mud or cuttings 38. The intermediate blade 25 and its bracket 85 are arranged to present the intermediate blade 25 as a perpendicular surface for scraping the left-over onslaught of adhering accumulations of mud or cuttings 38. Accordingly, it is held on more or less a radial axis by its straight or cantilevered bracket.

The trailing blade 26 that is arranged on the acute angle of attack is held by its L-shaped bracket 86, except this L-shaped bracket 86 is flipped relative to the leading blade 24's L-shaped bracket 84 such that this orientation of blade 26 and L-shaped bracket 86 is designed to increase the digging pressure of the trailing blade 26 accordingly into the onslaught of the residual adhering accumulations of mud or cuttings 38.

FIG. 4 shows best the progressive work of the three (3) blades 24-26 according to their respective angle of attacks and respective designs of their brackets 84-86. The leading blade 24 is designed to not only scrape off adhering accumulations of mud or cuttings 38 but also ride out away from a particularly heavy, thick and/or gummy boundary layer of such. As the leading blade 24 is pushed away (which is down in FIG. 4), the movement of the lower jaw 62 away from the central axis of the auger section 14 only increases the tension in the extensible tension link 66. This in consequence increases the pull on the upper jaw 61 in towards the central axis of the auger section 14, which increases the digging pressure of the trailing blade 26.

As the intermediate blade 25 encounters the left-over and particularly toughly stuck-on boundary layer of adhering accumulations of mud or cuttings 38, it too might not get all of that stuff (some, but not all) and in result be pushed radially out just as was the leading blade 24. But it will be seen in FIG. 4 that radial outward movement of the intermediate blade 25 causes the jaws 61-62 as a unit to more or less move to the right in FIG. 4 (ie., towards the drill rig 12). That movement likewise increases the digging pressure of the trailing blade 26.

The trailing blade 26 is the last-in-line of the blades 24-26 to tackle the residual adhering accumulations of mud or cuttings 38. The trailing blade 26 is arranged to attack the residual adhering accumulations of mud or cuttings 38 at an acute angle. If the residual boundary layer is particularly toughly stuck-on, rather than being arranged to slip outwards, the leading blade 24 is arranged to dig into with even more force. Moreover, the L-shaped bracket 86 therefor is turned to enhance the digging effect.

Figure 8:
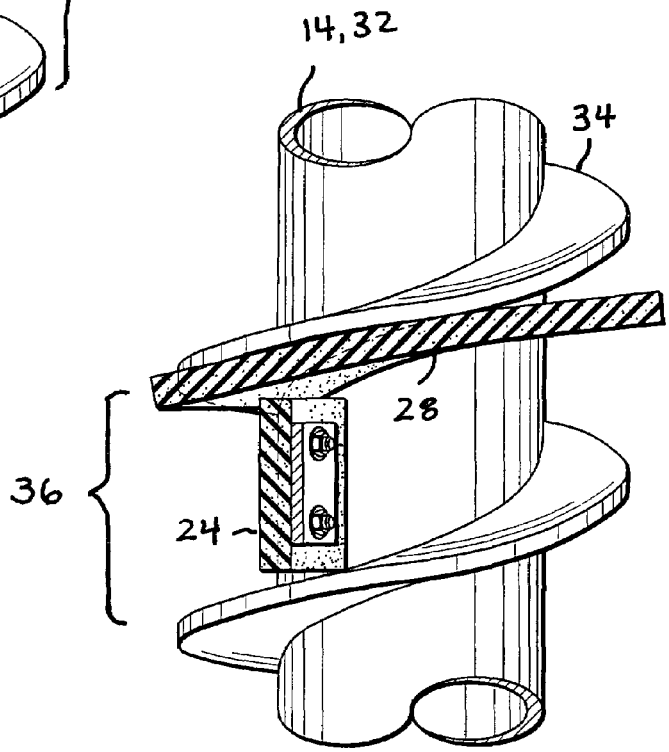

FIGS. 4, 6 and 8 show that the lower jaw 62 carries a runner 28 in close association with the leading blade 24. Like the wiper blades 24-26, preferably the runner 28 is produced of hard, synthetic rubber material. FIG. 8 shows that the runner 28 is disposed above the leading blade 24, and projects into the helical channel that constitutes the flute 36 for the auger section 14.

Briefly, as a matter of background, the auger section 14's screw 34 winds around in a helical path according to right-hand thread. Therefore, to bore into the earth the auger section 14 would be spun in the forward direction, which is the same for right-hand thread as being twisted clockwise (when viewed from above). Correspondingly, to spin the auger section 14 out of the bore hole it would be spun in the reverse direction, which is the same for right-hand thread as being twisted counterclockwise.

Given the foregoing, the runner 28 and leading wiper blade 24 are arranged to project into a common same coil of the helical channel that constitutes the flute 36 for the auger section 14 (a "coil" comprises one full circuit of the screw 34 or, according to context, flute 36:—wherein the screw 34 or flute 36 as a whole comprises numerous coils, and any given coil is any arbitrary full circuit of the screw 34 or, according to context, flute 36).

The runner 28 is disposed to ride under the lower helical surface of the screw 34, as shown best in FIG. 8. That way, when the auger section 14 is being spun in reverse—which is the same as being twisted in the counterclockwise direction—the runner 28 is pushed down against by the screw 34's lower helical surface. In consequence, this drives the shackle assembly 60 and carriage 52—as a unit—down the auger section 14, with the wiper blades 24-26 plowing through the adhering accumulations of mud and cuttings 38 in the progressive fashion as described above.

FIGS. 4 and 6 show that the runner 28 has terminal edge formed with a recess 87 in the shape of a segment of a circle (ie., that part of a circle bounded by a chord and an arc). The arc edge of this recess 87 is intentionally gapped away from the outer lateral (ie., cylindrical) surface of the auger stem 32 by gap 89 as shown. It is a design preference that the runner 28 not rub against the lateral side of the auger stem 32, but instead, ride under the screw 34's lower helical surface.

Figure 7:
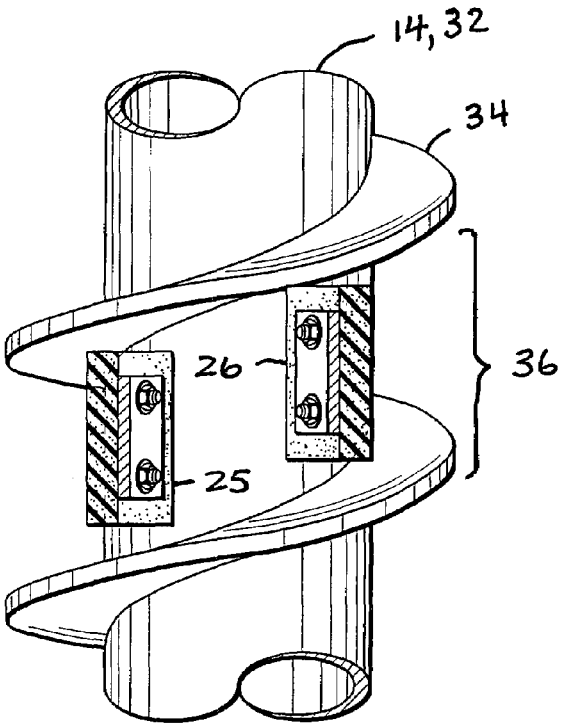
FIG. 7 is an elevational view, partly in section, taken in the direction of arcuate view-line's arrows VII-VII in FIG. 6; and, FIG. 8 is a comparable elevational view, partly in section, except taken in the direction of arcuate view-line's arrows VIII-VIII in FIG. 6.

FIGS. 7 and 8 show the relative positional placements of the three (3) blades 24-26. This positional placement is more particularly in respect to the helical channel that constitutes the flute 36. The blades 24-26 are alike in being staged to service a respective crosswise axis relative to the flute 36 (which crosswise axes are, given the upright orientation of the auger section 14 in FIGS. 7 and 8, the vertical spacing between adjacent coils of the screw 34, and as parallel to the axis of the cylindrical auger stem 32).

Briefly—in review—the leading, intermediate and trailing wiper blades 25 and 26 are angularly staged in the eight, two and eleven o'clock positions respectively (when given the viewpoints of FIG. 4 or 6). Correspondingly—the leading, intermediate and trailing wiper blades 25 and 26 are angularly staged in the eight, two and eleven o'clock positions respectively are axially staged (eg., elevation-wise) progressively to match the helix of the flute 36. Hence relative the leading blade 24 is, the intermediate blade 25 is higher and the trailing blade 26 is highest.

However, none of the foregoing deals with the subtle positional placements of the three (3) blades 24-26 which FIGS. 7 and 8 show. To the contrary, FIGS. 7 and 8 show that none of the blades 24-26 is so wide as to occupy the whole cross-wise span of the channel of the flute 36. Instead, all the blades 24-26 are a little undersized. It may appear that the leading blade 24 is intentionally undersized to accommodate for the inclusion of the runner 28, but that is not necessarily the primary design intention for the leading blade 24. Indeed, the intermediate and trailing blades 25 and 26 are likewise undersized, and they do not have to accommodate anything like the runner 28. The primary design intention for the blades 24-26 being undersized is something different.

FIG. 8 shows that the leading blade 24 is positioned so that its lowest corner scrapes tightly inside the low intersection between the helical screw 34 and the cylindrical lateral surface of the auger stem 32. In contrast, FIG. 7 shows that the trailing blade 26 is positioned so that its highest corner scrapes tightly inside the high intersection between the helical screw 34 and the cylindrical lateral surface of the auger stem 32. FIG. 7 also shows that the intermediate blade 25 occupies a middle position inside the channel of the flute 36, gapped away from both the high and low intersections of the helical screw 34 and the cylindrical lateral surface of the auger stem 32.

The primary design intention behind this is at least twofold. For one thing, because of the respectively different angles of attack of the three blades 24-26, each blade 24-26 is positioned in the channel of the flute 36 where it is least likely to be interfered with by the warp of one, the other or both of the upper and lower helical surfaces of the screw 34. In other words, it is not practical to size the blades 24-26 for full-channel width across the flute 36 or there would be clearance problems. One, the other or both the upper and lower helical surfaces of the screw 34 would pinch or bind the blades 24-26. Hence the blades 24-26 are undersized to prevent this, and then logically positioned such that whole channel is serviced by at least one or another of the blades 24-26.

For another thing, the drawing figures illustrate an idealized screw 34. That is, the illustrated screw 34 is perfectly helical, and the channel of the flute 36 is uniform at every span. In the real world, many factors conspire against this idealized depiction of the screw 34 and channel of the flute 36. One factor includes variances introduced during manufacturing. The screw 34 might possibly be fabricated to fairly near perfect proportions, but after being welded onto the cylindrical lateral surface of the auger stem 32, imperfections are no doubt introduced.

More significantly, after extended use, the helical screw 34 experiences all kinds of hardship. It may be called on to course through not only rich soil or sand but also rock or reinforced concrete and so on. After extended use, the helical screw 34 shows all kinds of scars inflicted by all kinds of insults, and is far from perfect. In various places the screw 34 will be bent by hard but irregularly hard substrate, filed down by abrasion, bent by engulfing hard intrusions in an otherwise soft substrate, and so on.

Hence FIGS. 7 and 8 show relative positional placements for the three (3) blades 24-26 which, in accordance with a preferred design intention, accommodates scarred auger sections 14 the scarring of which results from normal wear and tear in a tough use environment.

Pause can be taken now to transition to describing a preferred manner of use of the flute-wiping auger cleaner 20 in accordance with the invention. FIG. 2 shows the string of auger sections 14 being retracted from the bore hole by the drill drive 16 of the drill rig 12. The auger cleaner 20 is shown already engaged. At an earlier time, the auger cleaner 20 would have been disengaged. The extensible tension link 66 would have been slack and dangling down freely.

To engage the disengaged auger cleaner 20, workers preferably take the following steps. That is, a worker would grab the laterally-shearing handles 63-64 with both hands, open the jaws 61-62 wide, and lift the auger cleaner 20 to an elevation not only at a high point on the fouled auger section 14 but also to an elevation where the vertically-traveling carriage 52 is near the top of the vertical track 50. Then the worker closes the jaws 61-62 such that the wiper blades 24-26 insert inside the channel of the flute 36. The worker (or a helper) next grabs the crank end 76 of the lever 68 as well as the eye loop 73 of the extensible tension link 66 and fishes the hook end 78 to catch the eye loop 73. Once caught, the worker handling the crank end 76 then forces the crank end 76 against the strap 79 that acts as the fulcrum to spread the extensible tension link 66, at the same time grabbing the grip 82 on the latch 72, and then latches the crank end 76 in a clamped position as shown in FIG. 2 or 3.

Given the foregoing, the auger cleaner 20 is set in place to do its job. Preferably the worker runs the drill rig 12's drill drive 16 in reverse. The auger cleaner 20's runner 28 forces the shackle assembly 60 to descend in elevation such that the wiper blades 24-26 encounter and scrape off any adhering accumulations of mud or other cuttings 38. At the same time, the vertically-traveling carriage 52 descends smoothly down the vertical track 50 while concurrently supporting the shackle assembly 60 in its attitude. At the end of the downstroke for the shackle assembly 60, the worker switches the drill rig 12's drill drive 16 to OFF, disengages the shackle assembly 60, and then uses the drill rig 12's drill drive 16 to hoist up the string of auger sections 14 another five feet or so (~1½ meters) or so.

As an aside, hollow stem auger sections 14 are conventionally a standard five feet in length (~1½ m) in length. Preferably the vertical track 50 of the auger cleaner 20 is a corresponding five and a-half feet (~1⅔ meters) or so. That way, each pass with the auger cleaner 20 results in cleaning one auger section 14, which can then be detached from the string as a whole and racked up on the drill rig 12's storage racks therefor (not shown). Successive sections 14 of the auger string are cleaned as described.

By design intention, one method of cleaning the auger sections 14 contemplates down strokes which are induced by operating the drill rig 12's drill drive 16 in reverse, then up strokes which are manipulated manually:—as by manually disengaging the shackle assembly 60 in a low position, hydraulically hoisting up the string of auger sections 14 by the drill rig 12's drill drive 16, and then re-engaging the shackle assembly 60 manually at a high position.

An alternative method of cleaning the auger sections 14 contemplates leaving the auger cleaner 20's shackle assembly 60 clamped ON for the duration, wherein the step of hydraulically hoisting up the string of auger sections 14 by the drill rig 12's drill drive 16 is done so by one stroke at a time so that the shackle assembly 60 and carriage 52 combination is passively carried up the vertical track 50 by the increment of one short hoist of the drill rig 12's drill drive 16 at a time (eg., about five feet or 1½ meter increments at a time). Needless to say, the drill drive 16's spinning operation is most preferably switched OFF during the hoist operation.

This disclosure incorporates by reference the disclosure of commonly-invented, commonly-owned co-pending U.S. patent application Ser. No. 11/546,924, filed Oct. 11, 2006, as well as all its priority applications, as if such were set forth in full fully next.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. Apparatus for presenting wipers to fouling material in a flute of an earth-boring auger that has a helical screw wound around a cylindrical sidewall such that the helical screw defines a helical interspace between coils of the helical screw, wherein such helical interspace is the flute of the auger: said apparatus comprising:

a yoke adapted for longitudinally axial travel relative to a central longitudinal axis of the auger's cylindrical sidewall:

a plurality of wipers which, relative to the central longitudinal axis of the auger's cylindrical sidewall, are angularly and axially staged on the yoke along a helical path corresponding to the helical interspace defined by said auger's helical screw and which constitutes the flute of the auger, said plurality of wipers being provided for projecting into the flute while the auger spins;

whereby the longitudinally axial travel of the yoke relative to the spinning auger affords the wipers opportunity to wipe the fouling material out of the flute after an earth-boring use of the auger;

a longitudinally axial track, rigidly supported in a spaced parallel relationship with the central longitudinal axis of the auger's cylindrical sidewall; and a traveling carriage mounted on the axial track for supporting the yoke;

wherein the axial track includes a stand adapted to stand the track vertically off an earth-boring drilling rig while the auger is spun by a drill drive of the earth-boring drilling rig soon after withdrawal of the auger from an earth bore.

2. Apparatus for presenting wipers to fouling material in a flute of an earth-boring auger that has a helical screw wound around a cylindrical sidewall such that the helical screw defines a helical interspace between coils of the helical screw, wherein such helical interspace is the flute of the auger; said apparatus comprising:

a yoke adapted for longitudinally axial travel relative to a central longitudinal axis of the auger's cylindrical sidewall; and a plurality of wipers which, relative to the central longitudinal axis of the auger's cylindrical sidewall, are angularly and axially staged on the yoke along a helical path corresponding to the helical interspace defined by said auger's helical screw and which constitutes the flute of the auger, said plurality of wipers being provided for projecting into the flute while the auger spins;

whereby the longitudinally axial travel of the yoke relative to the spinning auger affords the wipers opportunity to wipe the fouling material out of the flute after an earth-boring use of the auger;

wherein the yoke comprises a laterally-shearing shackle assembly and a biasing arrangement therefor for pressuring the wipers inwards towards the auger's cylindrical sidewall while allowing the laterally-shearing shackle assembly to open slightly against the force of the biasing arrangement in event a wiper cannot dislodge a difficult clump of fouling material passing thereunder as the auger is spun on axis, whereby the wiper is pushed out and then pressured back in as the wiper rides over the difficult-to-dislodge clump.

3. The apparatus of claim 2 wherein the plurality wipers are angularly staged relative to the central longitudinal axis of the auger's cylindrical sidewall in combination with the biasing arrangement being configured such that the pushing out of one of the plurality of wipers only increases the pressuring-in force on another of the plurality of wipers.

4. The apparatus of claim 3 wherein the laterally-shearing shackle assembly comprises a pair of laterally shearing jaws traveling in parallel planes wherein at least one of the plurality of wipers is carried by one jaw and at least one other of the plurality of wipers is carried by the other jaw.

5. The apparatus of claim 4 wherein each jaw extends between a pivoted base and a distal tip end, and these tip ends have handles mounted thereto for manual manipulation by a user thereof, not only for opening the jaws but also for traversing the shackle assembly axially.

6. The apparatus of claim 4 wherein the biasing arrangement comprises a manually releasable latching system having a spring-tensioned link and a fastening link, said spring-tensioned link extending between a connection proximate the tip end of one jaw and a spaced-away coupler, said fastening link extending between a connection proximate the tip end of the other jaw and a spaced-away coupler counter-part to the coupler of the spring-tensioned link;

whereby said biasing arrangement is manually operative among pressuring and released modes.

7. The apparatus of claim 6 wherein the releasable latching system includes a mechanism having tensioning and slackening strokes for loading and un-loading respectively the spring-tensioned link with tension.

8. The apparatus of claim 7 wherein the fastening link comprises a lever having an intermediate fulcrum movably connected proximate the tip of the other jaw and extending in one direction to the spaced away, counter-part coupler, and extending in the other direction as a crank for manual manipulation thereof by a user.

9. The apparatus of claim 8 wherein the releasable latching system further comprises a releasable lock such that the crank allows the user to load or un-load respectively the spring-tensioned link with tension, and the lock allows the user to lock the lever with the spring-tensioned link loaded in a state of tension.

10. The apparatus of claim 3, for an auger in which said helical screw comprises a helical ribbon and said flute thereby comprises a helical channel, wherein:

each of the plurality of wipers comprises a blade having an elongated wiping edge arranged to wipe against the auger's sidewall, and each of the plurality of blades further having a flanking pair of edges intersecting the wiping edge at longitudinally spaced corners and extending along respective, longitudinally-spaced radial axes relative to the central longitudinal axis of the auger's cylindrical sidewall.

11. The apparatus of claim 10 wherein the plurality of blades comprise at least a leading blade and a trailing blade, regardless of the spin direction of the auger, and wherein both blades are radially inclined such that the leading blade is angled at an oblique angle in order to better survive the oncoming onslaught of fouling material and ride over difficult-to-dislodge clumps whereas the trailing blade is angled at an acute angle in order to better scrape into the residual fouling material that passes the leading blade.

12. The apparatus of claim 10 wherein the plurality of blades comprise at least a leading blade and a trailing blade, regardless of the spin direction of the auger, and further comprising an intermediate blade wherein the leading, intermediate and trailing blades are angularly staged relative to the central longitudinal axis of the auger's cylindrical sidewall in order to centrally stabilize said apparatus on the turning axis of the auger.

13. The apparatus of claim 10 wherein the plurality of blades comprise at least a leading blade and a trailing blade, regardless of the spin direction of the auger, and further comprising a runner attached to one jaw that is disposed in the helical channel that constitutes the flute, arranged to bear against a fraction of a turn of one surface of the helical ribbon helical screw such that spinning the auger in one direction causes the helical ribbon helical screw's one surface to thrust the runner axially, whereby the blades longitudinally axially traverse the longitudinal length of the auger relative to the central longitudinal axis of the auger's cylindrical sidewall.

14. The apparatus of claim 13 wherein the runner is disposed near the leading blade, and the trailing blade is positioned such that the wiping edge and one of the flanking edges thereof are pressured tightly in the intersection between the auger's sidewall and the helical ribbon helical screw's one surface in order that the trailing blade's said one flanking edge receives an axial-thrusting force partly balance with that received by the runner from the helical ribbon helical screw's one surface.

15. The apparatus of claim 14 wherein the trailing blade's wiping edge extends less than full longitudinal axial span of the helical channel that constitutes the flute, and which longitudinal axial span is taken relative to the central longitudinal axis of the auger's cylindrical sidewall, in order to avoid binding at pinch points where the helical ribbon helical screw is warped.

16. The apparatus of claim 15 wherein the leading blade is positioned such that the wiping edge and one of the flanking edges thereof are pressured tightly in the intersection between the auger's sidewall and the helical ribbon helical screw's other surface in order to reach the intersection not targeted by the trailing blade.

17. The apparatus of claim 13 further comprising:

a longitudinally axial track rigidly supported in a spaced parallel relationship with the central longitudinal axis of the auger's cylindrical sidewall; and a traveling carriage mounted on the axial track for supporting the shackle assembly.

* * * * *